US008631814B2

(12) United States Patent
Hartmann

(10) Patent No.: US 8,631,814 B2
(45) Date of Patent: Jan. 21, 2014

(54) FLOW CONTROL DEVICE

(76) Inventor: Frank Hartmann, Ardagh (IE)

( * ) Notice: Subject to any disclaimer, the term of this patent is extended or adjusted under 35 U.S.C. 154(b) by 220 days.

(21) Appl. No.: 12/747,756

(22) PCT Filed: Dec. 12, 2008

(86) PCT No.: PCT/EP2008/067472
§ 371 (c)(1),
(2), (4) Date: Jul. 26, 2010

(87) PCT Pub. No.: WO2009/074689
PCT Pub. Date: Jun. 18, 2009

(65) Prior Publication Data

US 2010/0282334 A1 Nov. 11, 2010

(30) Foreign Application Priority Data

Dec. 12, 2007 (IE) ..... S2007/0898

(51) Int. Cl.
*F16T 1/20* (2006.01)
*F16K 31/18* (2006.01)

(52) U.S. Cl.
USPC ..... 137/192; 137/430

(58) Field of Classification Search
USPC ..... 137/177, 183, 187, 192, 197, 202, 173, 137/179, 181, 203, 204, 397, 429, 430, 432, 137/433, 587, 589
See application file for complete search history.

(56) References Cited

U.S. PATENT DOCUMENTS 3,878,970 A * 4/1975 Nezworski ..... 222/61
5,529,086 A * 6/1996 Kasugai et al. ..... 137/202
5,685,352 A * 11/1997 Faught ..... 141/331
6,082,389 A * 7/2000 Latham et al. ..... 137/170.2
7,011,105 B2 * 3/2006 Muller ..... 137/202

FOREIGN PATENT DOCUMENTS

GB 501061 A 2/1939
GB 692515 A 6/1953
GB 2397111 A * 7/2004
IE 790229 L 8/1980
IE 80812 B3 * 3/1999

OTHER PUBLICATIONS

International Search Report, dated Oct. 13, 2009, received in international patent application No. PCT/EP2008/067472, 3 pgs.

* cited by examiner

*Primary Examiner* — John K Fristoe, Jr.
*Assistant Examiner* — Frederick D Soski
(74) *Attorney, Agent, or Firm* — Brian J. Colandreo; Pamela K. Soggu; Holland & Knight LLP

(57) ABSTRACT

A flow control device for use in a supply line between a pressurized liquid container and a dispenser for the liquid, the flow control device comprising a chamber (200) having an inlet (114) for receiving liquid from the container; a base section (102) comprising a chamber outlet (122) for supplying liquid to the dispenser; a vent valve (110) for venting gas from the chamber (200); a float valve (106) comprising a float section (142) and a seat section (146) and movable to and from an open position wherein the chamber outlet (122) is open to liquid flow and a closed position wherein the chamber outlet (122) is closed to liquid flow; and a float valve opening mechanism (120) Wherein the float section (142) of the float valve (106) comprises a plurality of protrusions (143), at least some of which engage the inside (138) of the chamber (200) so as to locate the float valve (106) substantially in line with the chamber outlet (122). In this way, the float valve can guide itself into the correct position without the need for additional guiding components.

7 Claims, 6 Drawing Sheets

FLOW CONTROL DEVICE

RELATED APPLICATIONS

The subject application is a U.S. National Stage application of International Application No. PCT/EP2008/067472, filed on 12 Dec. 2008, which claims the priority of Irish Patent Application No.: S2007/0898, filed on 12 Dec. 2007, the contents of which are herein incorporated by reference in its entirety.

INTRODUCTION

The present invention relates to a flow control device for use in a supply line between a pressurized liquid container and a dispenser for the liquid, the flow control device comprising a chamber having an inlet for receiving liquid from the container; a base section comprising a chamber outlet for supplying liquid to the dispenser; a vent valve for venting gas from the chamber; a float valve comprising a float section and a seat section and movable to and from an open position wherein the chamber outlet is open to liquid flow and a closed position wherein the chamber outlet is closed to liquid flow; and a float valve opening mechanism.

It is common for draught beer to be supplied from pressurized kegs to the taps at a bar using a pressurized gas. In this way, the pressurized gas effectively pushes the beer from the keg to the tap, through the supply line. However, as a keg empties and there is only a small amount of liquid left in the keg, the pressurized gas is known to create a foam from the remaining liquid. This foam then enters the supply line and will eventually reach the taps. This is undesirable as the foam or froth cannot be served to customers and must therefore be discarded, resulting in wastage and a decrease in profitability. Additionally, all the foam must be drained from the supply line when a new, full keg is fitted, thereby resulting in more wastage and also a delay in serving customers. Finally, the presence of foam in the supply lines can reduce the overall hygiene of the system.

In order to overcome these problems, the Foam On Beer (FOB) detector was developed comprising a chamber having a beer inlet and a beer outlet, fitted with a float valve. When the chamber is full of beer, the float valve floats in the liquid, thereby leaving the beer valve open and supplying beer to the taps. However, when foam or froth begins to develop in the chamber, the float valve is too heavy and will not float on the froth. It will consequently sink down to the beer outlet, closing it off and preventing the foam from entering the supply lines. Such a FOB detector is disclosed in International Patent Publication No. WO 97/4123.

There are a number of problems with the known FOBs. It is common to provide guide pins within the chamber to guide the float valve towards the beer outlet. International Patent Publication No. WO 97/4123 comprises bolts which hold the top and base of the chamber together. These bolts are accommodated in through-bores in the float valve such that the float valve is guided in its movement by the bolts and thus ensuring reliable operation of the float valve. Such bolts, guide pins, guide screws and their manner of engagement with the float valve, such as bores or recesses, provide breeding grounds for bacteria which can compromise the hygiene of the complete beer supply system. Additionally such components render the cleaning process for the FOB more complicated and often, less effective.

It is an object therefore of the present invention to provide a flow control device that provides for a more hygienic system.

STATEMENTS OF INVENTION

According to the invention there is provided flow control device for use in a supply line between a pressurized liquid container and a dispenser for the liquid, the flow control device comprising a chamber having an inlet for receiving liquid from the container; a base section comprising a chamber outlet for supplying liquid to the dispenser; a vent valve for venting gas from the chamber; a float valve comprising a float section and a seat section and movable to and from an open position wherein the chamber outlet is open to liquid flow and a closed position wherein the chamber outlet is closed to liquid flow; and a float valve opening mechanism characterised in that the float section of the float valve comprises a plurality of protrusions, at least some of which engage the inside of the chamber so as to locate the float valve substantially in line with the chamber outlet.

In this way, the float valve is guided into the correct location in the outlet by its own protrusions and therefore the flow control device does not require any further components in order to guide the float valve into the correct location in the chamber outlet to close off the flow of liquid from the chamber. This reduces the number of components and associated engagement pieces such as bores, recesses, screw-threads and the like within the chamber. This in turn facilitates an increase in hygiene within the FOB by reducing the number of areas where bacteria can accumulate and further makes the FOB easier to clean. Additionally, there remains space surrounding the float valve through which the beer may flow.

In one embodiment of the invention there is provided a flow control device in which the protrusions are substantially equidistant from each other. This is a particularly efficient manner of providing the protrusions, ensuring substantially uniform guiding irrespective of the revolution of the float valve about the axis of the chamber.

In another embodiment of the invention there is provided a flow control device in which the float section substantially comprises a right prism having a plurality of side edges. This is a particularly effective way of providing a float valve wherein the side edges of the prism provide the protrusions, while also providing a body to provide the floatation necessary for the operation of the float valve.

In a further embodiment of the invention there is provided a flow control device in which the side edges of the prism form the protrusions for engagement with the inside of the chamber. This is a particularly efficient method of providing the protrusions of the float valve.

In an alternative embodiment of the invention there is provided a flow control device in which the faces of the prism are concave. In this way, the cross-sectional area and consequently the volume of the float valve is reduced, while still allowing the protrusions thereof to engage the inner wall of the chamber, thereby providing for improved flow of beer passed the float valve.

In an embodiment of the invention there is provided a flow control device in which the chamber outlet is located centrally within the base section and the protrusions on the float section of the float valve act to locate the float valve centrally within the chamber. This is a particularly efficient embodiment of the flow control of the device, facilitating a regularly shaped float valve.

In an embodiment of the invention there is provided a flow control device in which the chamber is defined by the base section, a top section and at least one wall connected therebetween. This is a particularly efficient manner of providing the chamber of the invention. Preferably, the wall is a hollow cylindrical wall.

In one embodiment of the invention there is provided a flow control device in which the seat section of the float valve is adapted to engage the chamber outlet. In this way, the float valve will operate to close off the chamber outlet when there is no liquid within the chamber to cause the float valve to float.

In another embodiment of the invention there is provided a flow control device in which the vent valve is mounted in the top section. In this way, the vent valve is not in the path of the liquid within the chamber and the liquid will not in general come into contact with the vent valve. Therefore, any bacteria present in the vent valve have a reduced chance of contaminating the liquid in the chamber.

In a further embodiment of the invention there is provided a flow control device in which the vent valve is rotatably mounted in the top section. In this way, the vent valve may be rotated as necessary to facilitate the installation of a suitable vent line thereto.

DETAILED DESCRIPTION OF THE INVENTION

The invention will now be more clearly understood from the following description of an embodiment thereof given by way of example only with reference to the accompanying drawings in which:—

Figure 1:
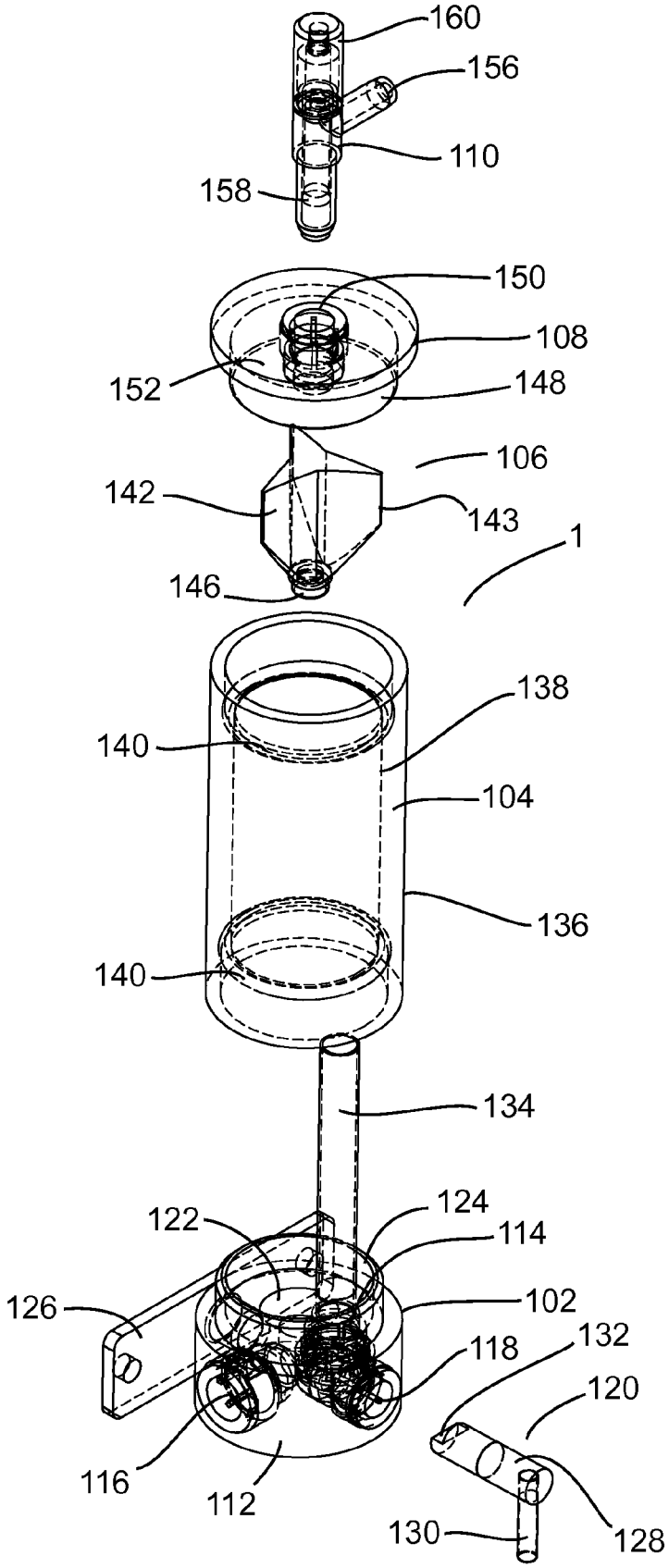
FIG. 1 is an exploded view of the device according to the invention.
Figure 3:
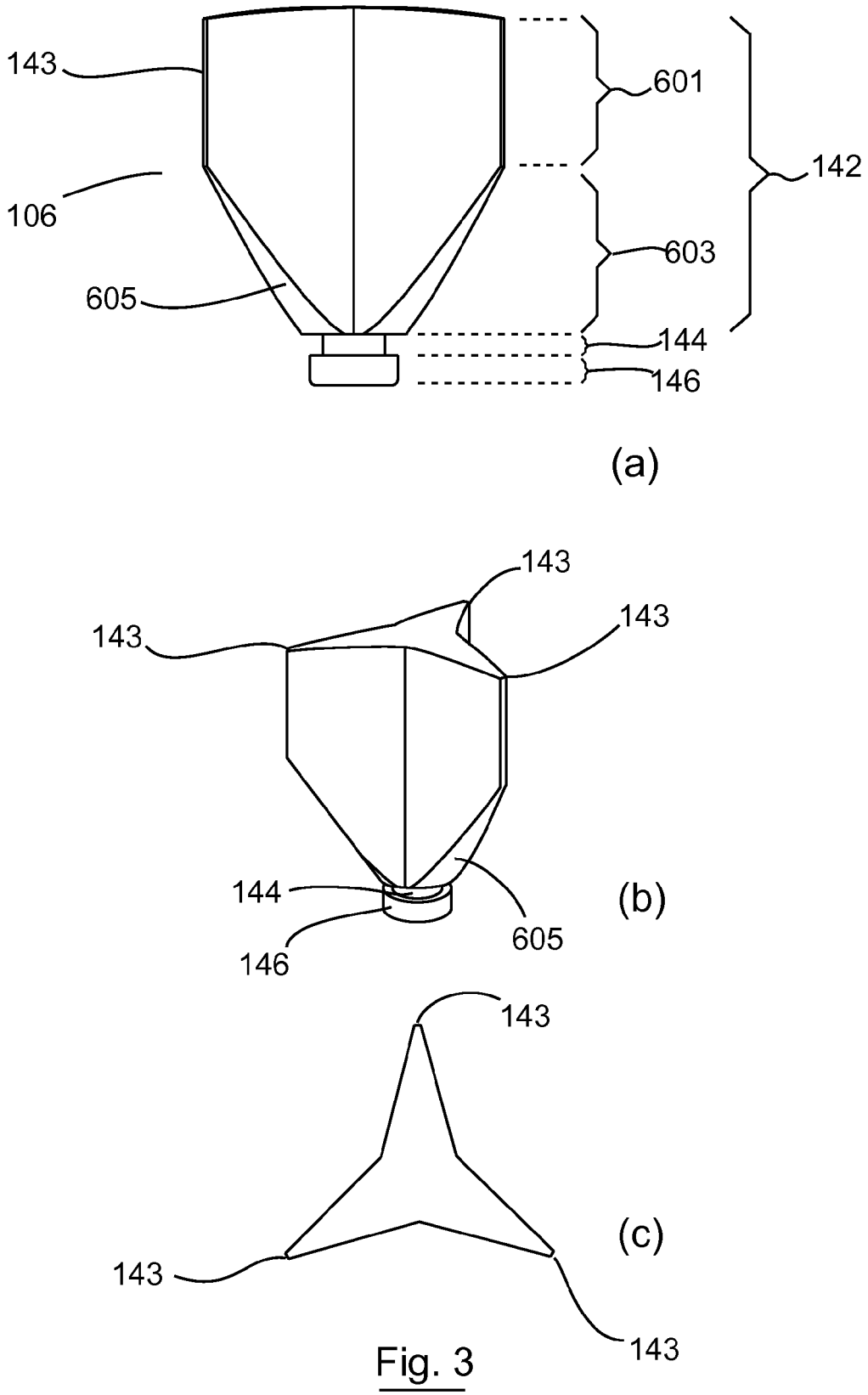
Figure 4:
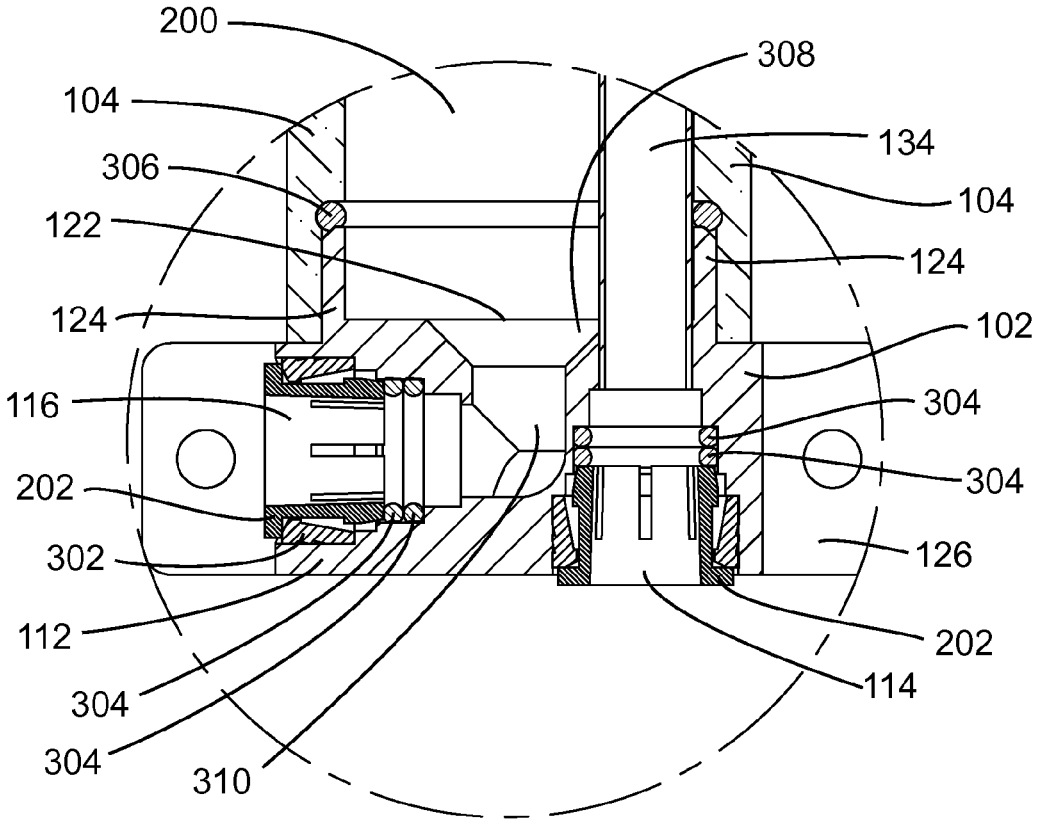
Figure 5:
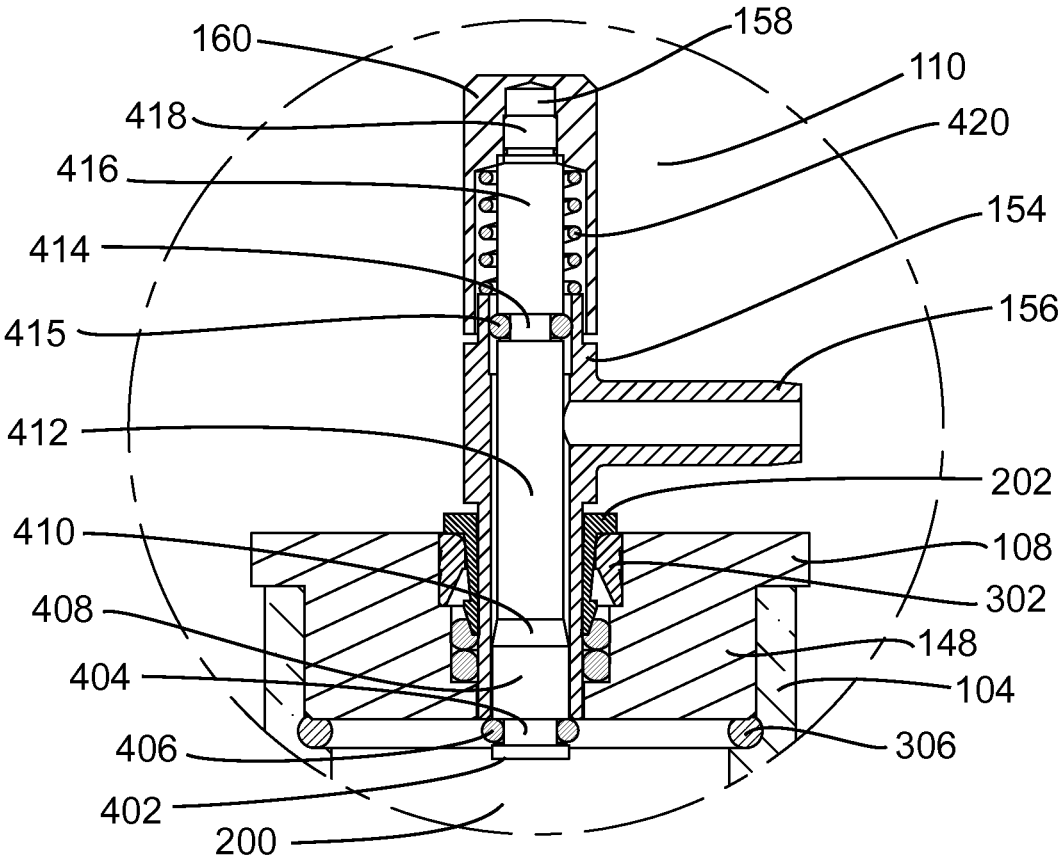
Figure 6:
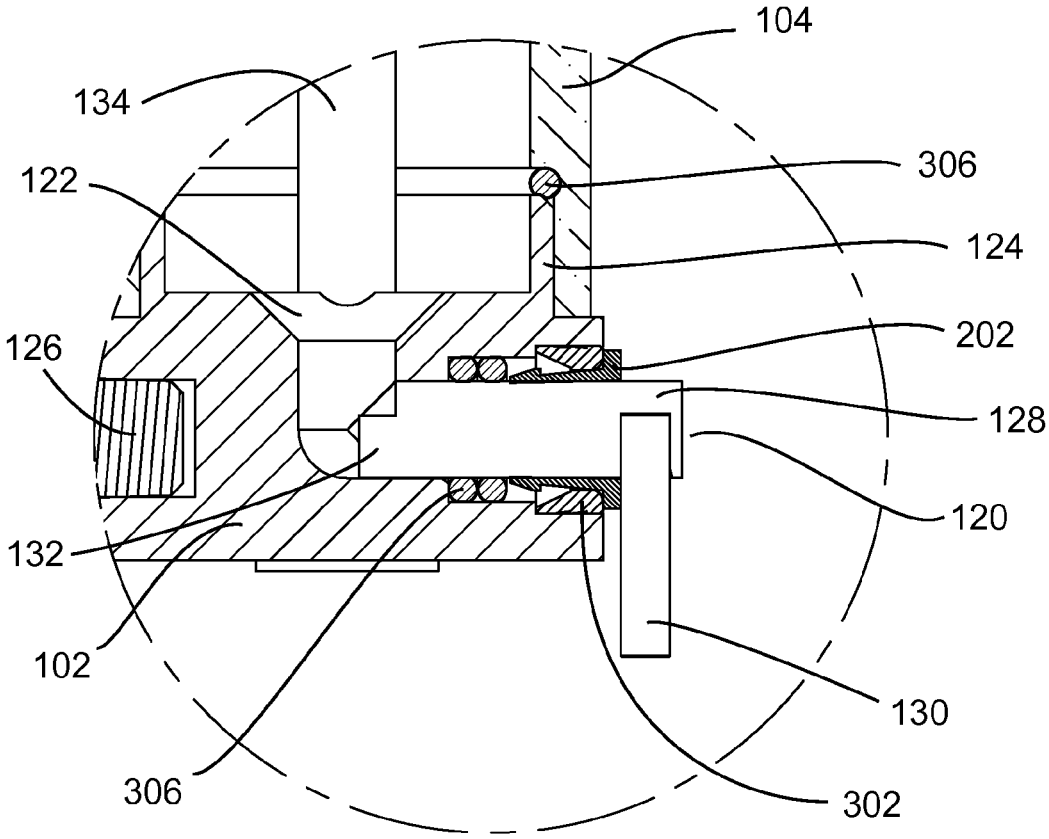

FIGS. 3(*a*), (*b*) and (*c*) are side, perspective and top views, respectively, of the float valve;

FIG. 4 is a detail cross-section view of a portion of the device showing the inlet and outlet;

FIG. 5 is a detail cross-section view of a portion of the device, including the vent valve; and FIG. 6 a detail cross-section view of a portion of the device showing the float lifter Referring to the drawings, and initially to FIG. 1 thereof, there is shown a flow control device indicated generally by the reference numeral 1, comprising a substantially cylindrical base section 102, a substantially cylindrical tube forming a wall 104, a float valve 106, a top section 108 and a vent valve 110. The wall 104, the base section 102 and the top section 108 together form a chamber for the reception of liquid from a pressurized container (not shown).

The base section 102 comprises a substantially solid, cylindrical lower portion 112 having a number of apertures formed therein. The apertures comprise a circular blind hole which extends downwardly from the centre of the upper surface of the lower portion 112, forming the chamber outlet 122; a vertical throughhole offset from the centre of the base section 102, and separate from the chamber outlet, forming the inlet 114; and a horizontal aperture, forming an outlet channel 116, which extends from the side of the lower portion 112 of the base section 102 to the centre of the base section 102 where it joins the chamber outlet 122. The base section further comprises an additional aperture, substantially orthogonal to the chamber outlet 122 and the outlet channel 116, that extends substantially horizontally from the side of the lower portion 112 of the base section 102 to the centre of the base section 102 forming a channel 118 for the float lifter 120. The channel 118 meets the outlet channel 116 and the chamber outlet 122. The chamber outlet 122 comprises a downward inwardly tapering section ending in a right cylindrical section (not shown), which is in communication with the outlet channel 116. The upper surface of the lower portion 112 of the base section 102 mounts a circular threaded flange 124 which is concentric with the base section and inwardly offset from the side of the lower portion 112 of the base section 102. Finally, mounted to the side of the base section 102 is a rectangular bracket 126 for mounting the device 1 on a wall (not shown) or other suitable support.

The float lifter 120, which operates as a float valve opening mechanism, comprises an elongate cylindrical body 128 dimensioned to rotatably and closely engage the channel 118 in the base section 102. One end of the cylindrical body 128 mounts an orthogonally projecting handle 130 to facilitate rotation of the float lifter 120, while the opposite end of the cylindrical body 120 mounts a curved shelf 132 projecting forwardly from the end of the cylindrical body 120, in line with the handle 130.

An inlet tube 134 is fitted to into the inlet 114 and projects upwardly from the base section 102 of the device 1. The wall 104 engages the base section and encloses the inlet tube 134. The wall 104 comprises an elongate hollow cylindrical section having an outer surface 136 and an inner surface 138. Adjacent each end of the wall 104, the inner surface supports a groove 140 for reception of a rubber O-ring (not shown) and a thread (not shown), for engagement with the threaded flange 124 on the base section 102 and a further thread (not shown) on the top section 108.

The float valve 106 comprises a float section 142 which tapers into a seat section 146. The float section 142 comprises a right triangular prism having substantially concave faces, such that the side edges of the prism form protrusions 143 for engagement with the inner surface 138 of the wall 104. The horizontal cross section of the float section 142 takes the form of a concave equilateral hexagon, wherein the hexagon comprises three convex apexes alternated with three concave apexes. The convex apexes correspond to the side edges of the prism and form the protrusions 143. The seat section 146 comprises a right cylindrical section that is narrow with respect to the float section 142, and is dimensioned to engage the chamber outlet 122 in a snug manner.

The top section 108 of the device comprises a solid, substantially cylindrical body 148 having a vertical throughhole 150 formed along its central axis and a laterally projecting lip 152 adjacent the top of the body 148. A thread (not shown) is formed on the outside surface of the cylindrical body below the lip 152.

The vent valve 110 comprises an upright vent body 154 having a vent tube 156 projecting orthogonally therefrom and in communication therewith. A vent spindle 158 is inserted through the vent body 154 and fitted with a cap 160.

Figure 2:
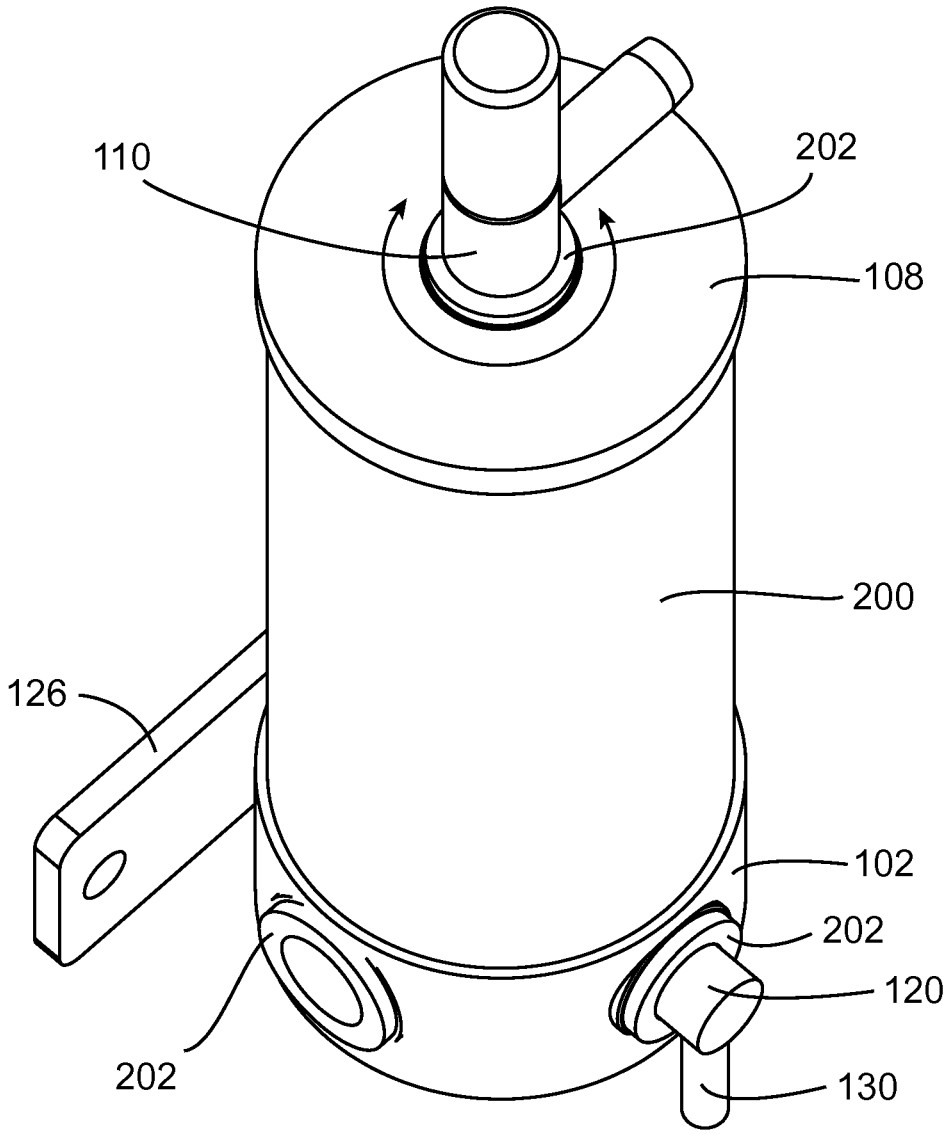
FIG. 2 is a perspective view of the device according to the invention.

Referring now to FIG. 2, in which like parts have been given the same reference numerals as before, there is shown a perspective view of the assembled flow control device 1. The vent valve 110 is inserted though the throughhole (not shown) in the top section 108. The vent valve 110 is rotatable about its vertical axis. The top section 108 and the base section 102 have been attached to the wall 104, forming a chamber 200 for the reception of fluid. The float lifter 120, with its handle 130, is shown inserted into the float lifter channel 118 in the base section. The base section 102 further comprises the outlet channel 116, and has the bracket 126 fitted thereto.

Each aperture on the outside surface of the flow control device, namely the throughhole 150 in the top section 108; the float lifter channel 118 in the base section 102; the outlet channel 116 in the base section 102 and the inlet 114 in the base section are fitted with a push-fit collet 202. During assembly of the flow control device, the collet 202 is loosely placed within the relevant aperture and the relevant fitting such as the vent valve or float lifter is then slotted into the aperture through the collet. The collet 202 is then pushed home by hand, securing the fitting in place. Subsequently, to remove the fitting, it suffices to hold the collet 202 in place by hand and the pull out the fitting, also by hand. Therefore, all the connections can be made without using tools, facilitating ease of installation and maintenance.

Referring now to FIGS. 3(*a*), (*b*) and (*c*), in which like parts have been given the same reference numerals as before, there is shown a side, perspective and top view respectively of the float valve 106. The float valve 106 comprises the float section 142, the seat section 146 and a narrow neck section 144 therebetween. The float section 142 comprises an upper float section 601 and a lower float section 603. The upper float section 601 comprises the right triangular prism having substantially concave faces, as described in relation to FIG. 1 above. The upper float section 601 therefore comprises the side edges of the prism that form the protrusions 143 for engagement with the inner surface 138 of the wall 104. The horizontal cross section of the upper float section 601 takes the form of a concave equilateral hexagon, wherein the hexagon comprises three convex apexes alternated with three concave apexes. The convex apexes correspond to the side edges of the prism and form the protrusions 143. The lower float section 603 comprises the section of the float valve 106 that tapers from the upper float section 601 to a point where the float valve narrows into the neck section 144. In the lower float section 603, the side edges of the prism forming the float section 142 of the float valve 106 are sliced away such that edges become substantially triangular faces 605, inclined inwardly and downwardly. The seat section 146 comprises a right cylindrical section that is narrow with respect to the float section 142, but is wider than the neck section 144. The seat section 146 is dimensioned to engage the chamber outlet 122 in a snug manner. The neck section 144 forms a groove for reception of a small O-ring (not shown) so that in combination, the seat section and small O-ring act to close the chamber outlet to fluid flow when the sect section 146 engages therewith.

The top surface of the float valve 106 is slightly raised in the centre and slopes downwards therefrom. This facilitates the flow of liquid over the top of the float valve and ensures that no liquid will lie on the top of the float valve. This in turn ensures that the top of the float valve does not provide an area that would be difficult to clean or that would provide a location that would encourage the accumulation of bacteria.

Referring now to FIG. 4, in which like parts have been given the same reference numerals as before, there is shown a cross-section detail of the lower part of the flow control device 1. There is shown the horizontal aperture in the side of the lower portion 112 forming the outlet channel 116 of the flow control device 1. There is further shown the chamber outlet 122 extending downwardly from the centre of the surface of the lower portion 112 of the base section 102. The vertical chamber outlet 122 and the horizontal outlet channel 116 intersect thereby providing a path for liquid from the chamber 200 to exit the device 1. The chamber outlet aperture comprises a downward, inwardly tapering section 308 which joins a cylindrical section 310, which intersects with the aperture forming the outlet cannel 116.

There is further shown the inlet 114 extending vertically from the bottom of the base section 102 to the upper surface of the lower portion 112 of the base section 102 where is connects with the inlet tube 134 which extends upwardly into the chamber 200. Finally, there is shown the cylindrical wall 104 engaging the threaded flange 124 which projects upwardly from the lower portion 112 of the base section 102. A large O-ring 306 is positioned in a groove in the inner surface of the wall 104 where the wall 104 engages the threaded flange 124 of the base section 102. The O-ring 306 provides a seal.

The outlet channel 116 is fitted with a push-fit collet 202 which engages a collar 302 inserted into the aperture. Additionally, a pair of O-rings 304 are located within the outlet aperture 116 so as to form a seal. This arrangement of collet 202, collar 302 and O-rings 304 is repeated for the aperture forming the inlet 114 at the bottom of the base section 102.

Referring now to FIG. 5, in which like parts have been given the same reference numerals as before, there is shown a cross-section detail of the upper part of the flow control device 1. The vent valve 110 is fitted through the vertical, centrally located aperture in the top section 108 of the flow control device 1. The throughhole 150 is fitted with a push-fit collet 202 which engages a collar 302 inserted into the throughhole 150. Additionally, a pair of O-rings are located within the throughhole 150 so as to form a seal. The top section 108 itself engages the cylindrical wall 104 so as to seal the chamber 200. A large O-ring 306 is positioned in a groove in the inner surface of the wall 104 where the wall engages the thread (not shown) on the outside surface of the cylindrical body 148 of the top section 108. The vent valve 110 comprises a hollow, upright vent body 154 having a hollow vent tube 156 projecting orthogonally therefrom such the hollow sections of the vent body 154 and vent tube 156 are in communication; a vent spindle 158 inserted through the vent body 154, extending beyond the vent body at each end thereof and engaging a cap at its top end. The vent body is rotatable by 360° in the throughhole 150 but is otherwise fixed in place and does not move longitudinally. The vent spindle comprises an elongate substantially cylindrical body having a number of sections. The lowest section, forming the bottom of the vent spindle 158, comprises a thin, cylindrical lip section 402 above which is a first recessed section 404 of narrower diameter than the lip section. The first recessed section 404 is fitted with an O-ring 406 so as to provide a seal at the base of the throughhole 150. Above the first recessed section 404 is a wide cylindrical section 408, having the same diameter than the lip section. The wide cylindrical section 408 joins a tapering section 410 which tapers inwardly to an elongate, narrow cylindrical section 412, having a diameter less than that of the wide cylindrical section 408 but greater than that of the first recessed section. Above the narrow cylindrical section 412 is a second recessed section 414 which has a diameter less than the diameter of the first recessed section 404. The second recessed section 414 is fitted with an O-ring 415 which engages the inside of the vent body 154. Finally, above the second recessed section 414 is a top cylindrical section 416 which terminates in a narrow threaded section 418. A helical spring 420 is placed over the top cylindrical section such that it abuts against the top of the vent body 154. The spring is not wide enough to pass over the vent body. The cap 160 is fitted over the spring 420 and a thread (not shown) internal to the cap engages the threaded section 418 of the vent spindle 158, securing the cap 160 in place. The length of the vent spindle 158 is substantially equal to the combination of the height of the vent body 154 combined with the length of the cap 160.

In use, the vent valve 110 is held in a closed position as illustrated wherein the O-ring 406 fitted at the first recessed section 404 of the vent spindle 158 abuts the base of the throughhole 150 in the top section 108, thereby preventing gas or liquid from escaping via the throughhole 150. The vent spindle 158 is held in this closed position as its top end is attached to the cap 160 which is spaced apart, and biased away, from the vent body by the spring 420. The vent valve 110 is operated by pressing down on the cap 160 such that the spring 420, which rests on the top of the vent body, is compressed. Pressing down on the cap moves the vent spindle downwards through the vent body such that the tapering section 410 of the vent spindle is adjacent the base of the throughhole 150. In this way, there will be a pathway between the base of the throughhole 150 and the vent tube 156, thereby providing a pathway for gas and liquid from the inside of the chamber 200 to the outside of the device.

Referring now to FIG. 6, in which like parts have been given the same reference numerals as before, there is shown a cross-section detail of the lower part of the flow control device 1 comprising the base section 102 and the float lifter 120. The cross-section of FIG. 6 is taken along a line orthogonal to the line along which the cross-section of FIG. 4 is taken. The float lifter 120 comprises an elongate cylindrical body 128 which engages the float lifter channel 118 in the base section 102. The float lifter body 128 is dimensioned so as to be snugly rotatable within the channel. The float lifter is secured in place in the channel by way of the collet 202, collar 302 and O-ring assembly as used in the other apertures in the top section 108 and base section 102. The float lifter 120 further comprises a handle 130 projecting orthogonally from the float lifter body 128 adjacent one end thereof, and a curved shelf 132 projecting forwardly from the opposite end of the float lifter body 128. The float lifter 120 extends along the channel 118 into the base section 102 such that the shelf 132 will rest directly below the chamber outlet 122.

In use, the flow control device 1 is positioned in the supply line for a pressurized system between a container (not shown) for a liquid and the dispenser (not shown) for the liquid. A pipe (not shown) from the container is connected to the inlet 114 and a further pipe (not shown) is connected from the outlet to the dispenser. The vent valve 110 is operated, by pressing down on the cap 160, such that there is an escape path for the air in the chamber 200, allowing the chamber to fill with liquid from the pressurized supply line. The liquid will then enter the flow control device through the inlet 114 and pass up the inlet tube 134 into the chamber 200. As the chamber 200 fills with liquid, the float valve 106 will begin to float in the liquid, moving away from its seat position in the chamber outlet 122, thereby allowing the liquid to flow down through the chamber outlet valve and out of the flow control device through the outlet channel 116. However, as the level of liquid left in the container reduces and approaches emptiness, the gas used in the supply line will begin to cause the liquid to foam or froth. The level of liquid in the chamber 200 will drop as the froth is generated. As the liquid level drops, so does the float valve 106, as it will not float on the froth. As the float valve 106 drops, it will be guided into the correct position relative to the chamber outlet 122 by the protrusions 143. The diameter of the circumcircle of the cross section of the upper float section 601 of the float valve is slightly less than the inner diameter of the chamber. In this way, the float valve can only move slightly away from the central axis of the chamber before the protrusions abut against the inner surface of the wall 104. Additionally, the depth of the float valve 106 prevents it from flipping in the chamber ensuring that the seat section 146 will always be facing towards the chamber outlet 122. Therefore, as the liquid level in the chamber 200 drops, with float valve 106 will also drop until the seat section 146 of the float valve 106 engages the chamber outlet aperture 122, closing it off and preventing any further flow of liquid or foam from the chamber 200. Once the empty container has been replaced with a full one, the flow control device 1 can be reset by pressing on the cap 160 of the vent valve 110 so that the liquid can once again fill the chamber 200. If the float valve 106 does not immediately lift, it may be necessary to operate the float valve opening mechanism, in this case the float lifter 120, by rotating the float lifter body 128 using the handle 130. This causes the shelf 132 to unseat the seat section 146 of the float valve 106. The float valve 106 will then re-float itself and the flow control device 1 operates as described. The float lifter 120 will also be raised during the clean of the supply line so as to allow the detergents that are passed through the system to access all areas of the base section 102 of the flow control device 1.

It will be understood by the person skilled in the art that the flow control device is preferably for use in a draught beer supply line, for example, in a bar or restaurant, but that it is not limited to that particular usage. Preferably, the base section and top section are manufactured from precision machined, food grade stainless steel, while the wall 104 is preferably manufactured from polymethymethacrylat, more commonly known as sight glass. The O-ring seals used throughout are of food grade quality and the float valve is preferably manufactured from polypropylene. It will be further understood that the float valve must be manufactured from a material that will be of a suitable density to allow it to float in the liquid used in the system.

In the specification the terms 'comprise', 'comprises', 'comprised' and 'comprising' or any variation thereof and the terms 'include', 'includes', 'included' or 'including' or any variation thereof are considered to be totally interchangeable and they should all be afforded the widest possible interpretation.

The invention is not limited to the embodiment herein described, but may be varied in both construction and detail within the terms of the claims.

The invention claimed is:

1. A flow control device for use in a supply line between a pressurized liquid container and a dispenser for the liquid, the flow control device comprising a chamber defined by a base section, a top section and at least one wall connected therebetween, the chamber having an inlet for receiving liquid from the container;

the base section comprising a chamber outlet for supplying liquid to the dispenser;

a vent valve for venting gas from the chamber;

a float valve comprising a float section and a seat section and movable to and from an open position wherein the chamber outlet is open to liquid flow and a closed position wherein the chamber outlet is closed to liquid flow; and a float valve opening mechanism wherein the float section of the float valve comprises a right prism having a plurality of side edges, the side edges forming a plurality of protrusions at least some of which engage an inner surface of the wall of the chamber so as to locate the float valve substantially in line with the chamber outlet, and in which the faces of the right prism are concave.

2. The flow control device as claimed in claim 1 in which the chamber outlet is located centrally within the base section and the protrusions on the float section of the float valve act to locate the float valve centrally within the chamber.

3. The flow control device as claimed in claim 2 in which the vent valve is rotatably mounted in the top section.

4. The flow control device as claimed in claim 1 in which the protrusions are substantially equidistant from each other.

5. The flow control device as claimed in claim 1 in which the seat section of the float valve is adapted to engage the chamber outlet.

6. The flow control device as claimed in claim 1 in which the vent valve is mounted in the top section.

7. A flow control device for use in a supply line between a pressurized liquid container and a dispenser for the liquid, the flow control device comprising a chamber defined by a base section, a top section and at least one wall connected therebetween, the chamber having an inlet for receiving liquid from the container;

the base section comprising a chamber outlet for supplying liquid to the dispenser;

a vent valve for venting gas from the chamber;

a float valve comprising a float section and a seat section and movable to and from an open position wherein the chamber outlet is open to liquid flow and a closed position wherein the chamber outlet is closed to liquid flow; and a float valve opening mechanism wherein the float section of the float valve comprises a right prism having a plurality of side edges, the side edges forming a plurality of protrusions, substantially equidistant from each other, at least some of which engage an inner surface of a wall of the chamber so as to locate the float valve substantially in line with the chamber outlet, and in which the faces of the right prism are concave.

* * * * *